US006598248B1

(12) United States Patent
Ong

(10) Patent No.: US 6,598,248 B1
(45) Date of Patent: Jul. 29, 2003

(54) TOSS PILLOW WITH INTEGRAL BEDDING

(76) Inventor: Bon S. Ong, Box 4247, Torrance, CA (US) 90510

( * ) Notice: Subject to any disclaimer, the term of this patent is extended or adjusted under 35 U.S.C. 154(b) by 0 days.

(21) Appl. No.: 10/053,822

(22) Filed: Jan. 24, 2002

(51) Int. Cl.[7] ..... A47G 9/00; A47G 9/02
(52) U.S. Cl. ..... 5/436; 5/485
(58) Field of Search ..... 5/636, 482, 419, 5/413 R, 485, 502, 500, 417; 2/69.5

(56) References Cited

U.S. PATENT DOCUMENTS

| | | | | | |
|---|---|---|---|---|---|
| 1,871,003 | A | * | 8/1932 | Longletz et al. | 5/485 |
| 4,404,689 | A | * | 9/1983 | DeWan | 2/88 |
| 4,734,948 | A | * | 4/1988 | Danova | 5/502 |
| 4,774,734 | A | * | 10/1988 | Mills | 5/413 R |
| 5,920,931 | A | * | 7/1999 | Zuehlke et al. | 5/419 |
| 5,987,667 | A | * | 11/1999 | Haverly et al. | 5/485 |
| 6,367,083 | B1 | * | 4/2002 | November | 5/413 R |

* cited by examiner

*Primary Examiner*—Alexander Grosz
(74) *Attorney, Agent, or Firm*—Charles H. Thomas

(57) ABSTRACT

A combination of a pillowcase and a cover is constructed the so that the pillowcase is permanently attached to the central region of the cover and the cover may the folded and stuffed into the pillowcase or alternatively spread out to extend laterally from the pillowcase. The pillowcase is formed of front and rear panels. The front panel is permanently secured to the central region of the cover. The front and rear panels of the pillowcase are permanently secured together along only a portion of a mutually common enclosing perimeter, and are releaseably secured together along the remainder of that perimeter. The orientation of the rear panel is reversible so that it may reside exposed atop the cover with the front panel concealed therebetween when the cover is withdrawn from the pillowcase and spread out laterally therefrom. Alternatively, the rear panel may be reversed in orientation relative to the front panel so that the cover may be folded and stuffed in between the mutually facing reverse surfaces of the front and rear pillowcase panels and encapsulated within the pillowcase by closure of the releaseable fasteners. A zipper may be employed to form the releaseable fasteners on the pillowcase panels.

19 Claims, 10 Drawing Sheets

TOSS PILLOW WITH INTEGRAL BEDDING

BACKGROUND OF THE INVENTION

1. Field of the Invention

The present intervention relates to an article of bedding with an integral pillowcase.

2. Description of the Prior Art

At present conventional articles of bedding such as blankets, sheets, comforters, and other covers are formed of one or more layers of flexible fabric which may be spread out in a generally flat disposition to cover a wide, expansive area. Such covers may be folded for more compact storage. However, conventional covers lack any particular storage case that allows them to be conveniently transported or otherwise handled so that the cover does not readily unfold. Conventional pillows, such as toss pillows, are normally constructed with opposing, fabric panels that are fastened together around their edges after being filled with stuffing. The edges of the panels of conventional toss pillows are typically permanently secured throughout their entire perimeters and the soft, cushion material between them can serve no purpose other than stuffing for the pillow.

SUMMARY OF THE INVENTION

The present intervention is a unique article of bedding that is formed in such a way that it can be used as a cover and also converted to a toss pillow and which is also equipped with its own self-contained storage envelope. The article of bedding can be spread out in a sheet-like form so as to cover a rather large area. The bedding article may take the form of a comforter, blanket, sheet, beach towel, afghan, or bedspread. Actually, the invention is not limited to an article of bedding, since the same structural arrangement can be applied to items such as tablecloths, curtains, picnic blankets, play pen pads, and to other fabric or flexible plastic articles as well.

In any application of use, the invention involves a cover that may be spread out over a relatively large area, but which may be folded into a relatively small volume. The invention also includes a pair of flexible fabric panels that are disposed in a face-to-face arrangement and secured about their edges, at least in part, by releaseable fasteners. For identification purposes one of these panels may be considered to be a front panel and the other a rear panel. The front panel is located at the central region of the cover, and indeed, may even be formed by a central portion of the structure of the cover from which peripheral portions of the cover extend in all directions. The rear panel is coterminous with the front panel and is reversible.

The rear panel is preferably permanently attached to the front panel over a portion of the enclosing perimeter at which the panels meet. The releaseable fasteners extend along the remaining portion of the enclosing perimeter formed by the peripheral edges of the panels. When the releaseable fastener's are disengaged from each other, the peripheral regions of the cover may be folded up toward the central region and compacted so that the entire cover may be enveloped between the pair of panels. The releaseable fasteners are reengaged, thereby encapsulating the cover within the enclosed space defined between the two panels.

An article of bedding formed according to the present invention functions as a self-contained blanket or other cover and also as a toss pillow. When the cover is encapsulated within the enclosure between the two panels forming the opposing sides of the pillowcase, the article may be handled extensively and serve as a pillow, cushion, or other soft support. The article may also be conveniently transported and moved from place to place in this compacted condition without danger that the blanket might unfold. On the other hand, when the releaseable fasteners are disengaged, the cover may be withdrawn completely from within the pillowcase enclosure and its peripheral portions may be spread from the central region to cover a desired area, such as an area on a bed or upon the floor.

In one broad aspect the present invention may be considered to be a combination comprising: a pillowcase formed with front and rear panels each having an obverse and a reverse surface and said panels both have outer edges that meet to define an encompassing perimeter. The combination also includes mutually engageable, releaseable fasteners that releaseably engage the panels together along at least a portion of the encompassing perimeter. The combination further includes an expansive cover having top and bottom surfaces and delineating a central region at the front panel of the pillowcase. Peripheral portions of the cover project outwardly from a demarcation boundary beyond the central region at which the front panel of the pillowcase is located. With this construction the expansive cover is foldable for insertion in between the reverse surfaces of the pillowcase panels for encapsulation therebetween. On the other hand, the cover is also unfoldable so that the pillowcase surmounts the cover with the peripheral portions of the cover spread beyond and surrounding the pillowcase.

Preferably, the front and rear pillowcase panels both have a substantially congruent circular shape and are permanently secured together about a permanently attached portion of the encompassing perimeter. The permanently attached portion is preferably a semicircular, arcuate portion of the encompassing perimeter. Also, the front and rear panels are preferably both permanently secured to each other and to the cover along the permanently attached portion of the encompassing perimeter at a portion of the demarcation boundary delineating the central region and the peripheral portions of the cover. The permanent attachment of the panels of the cover coincides with the attachment of the panels together along the attached portion of the encompassing perimeter defined by the panels. The permanently attached portion of the encompassing perimeter preferably extends along one-half of the total length of the encompassing perimeter.

In the preferred arrangement the rear panel is reversible and is positionable relative to the front panel so that the reverse surfaces of the pillowcase panels face each other. When the panels are in this orientation, the peripheral portions of the cover can be folded in toward the reverse surface of the front panel so that the releaseable fasteners can be engaged to encapsulate the entire cover within the enclosed space defined between the front and rear panels. Alternatively, the rear panel orientation may be reversed relative to the front panel so that the obverse surfaces of the panels face each other. In this orientation the peripheral portions of the cover extend laterally outwardly from the central region of the cover and the rear panel is located atop the front panel at the central region of the cover. In a preferred arrangement, the releaseable fasteners are engageable with each other both when the reverse surfaces of the panels face each other and when the obverse surfaces of the panels face each other. This allows the pillowcase panels to be completely secured together throughout their edges irrespective of whether the obverse or reverse surfaces of the panels are in mutually facing relationship.

When the rear panel is arranged so as to be reversible in orientation relative to the front panel it is advantageous for the obverse surfaces of both the front and rear panels to be provided with mutually complementary surface ornamentation. In this way, when the article is utilized as a toss pillow, the exposed surfaces, namely the obverse surfaces, are decorated in an appropriate harmonious manner and in an aesthetically pleasing way so that the toss pillow has an attractive appearance. In addition, it is advantageous also for the reverse surface of the rear panel to be provided with surface ornamentation. In such an arrangement, when orientation of the rear panel is reversed, the rear panel forms an attractive design or ornamentation at the center of the cover when the cover is withdrawn from between the panels with its peripheral portions extended laterally therefrom.

In another aspect the invention may be considered to be a self-storing article of bedding comprising: an expansive cover within which a central region is defined surrounded on all sides by peripheral portions and having top and bottom surfaces. The article also includes a pillowcase formed of opposing front and rear panels, each having an obverse surface and a reverse surface. The front and rear panels have edges that meet to form an enclosing perimeter. At least a portion of the enclosing perimeter is bounded by mutually engageable, releaseable fasteners on both the front and rear panels. The front panel is located at the central region of the cover. With this construction the peripheral portions of the cover are foldable toward the central region thereof and the releaseable fasteners are engageable so that the obverse surfaces of the front and rear panels of the pillowcase are both exposed with the cover encapsulated between the reverse surfaces of the front and rear panels. The cover thereupon serves as stuffing for the toss pillow within the pillowcase. The cover is alternatively withdrawable from the pillowcase to completely surround and extend beyond the enclosing perimeter of the pillowcase panels.

The invention may be described with greater clarity and particularity by reference to the accompanying drawings.

DESCRIPTION OF THE EMBODIMENT

Figure 1:
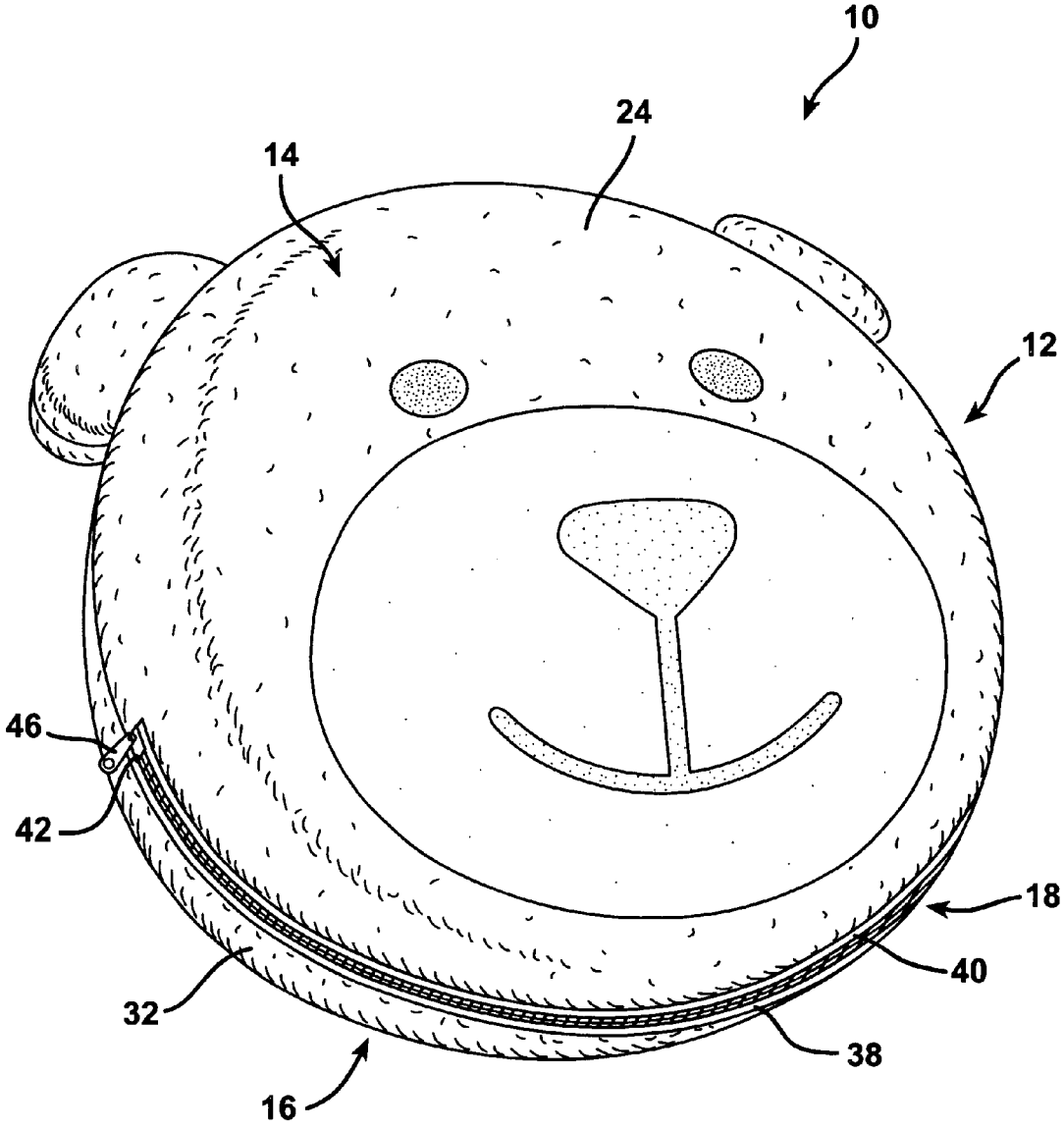
FIG. 1 is a perspective view of one embodiment of a toss pillow with integral bedding encapsulated therewithin according to the invention.
Figure 6:
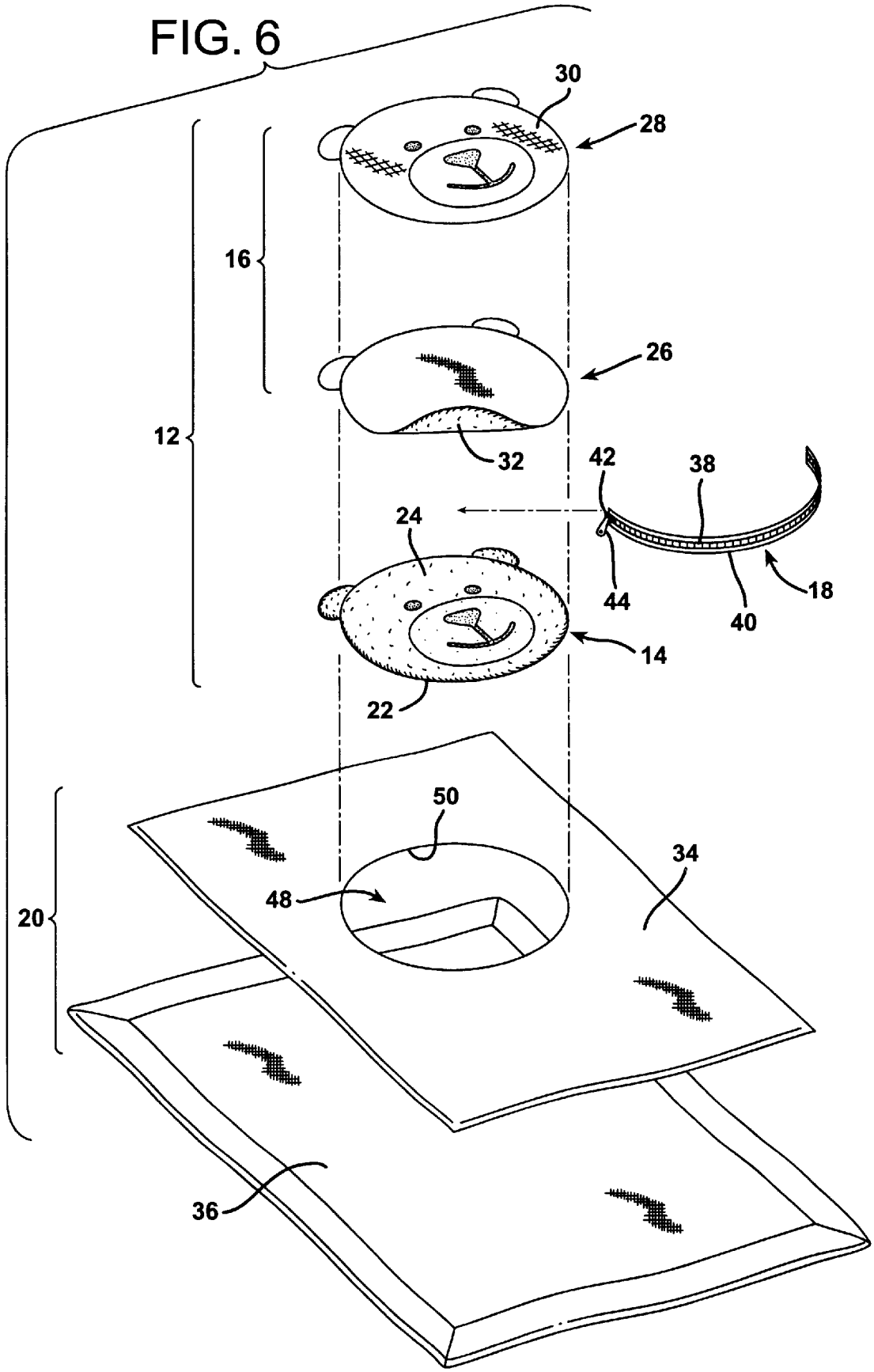
FIG. 6 is an exploded perspective view of the embodiment of the invention illustrated in FIGS. 1–5.

FIG. 1 illustrates a toss pillow with integrated cover indicated generally at 10. As best illustrated in FIG. 6, the device 10 is comprised of a pillowcase 12 formed of a front panel 14, a rear panel 16, releaseable fasteners formed as components of a zipper 18, and an expansive, flexible, fabric cover 20.

The front panel 14 has a reverse surface 22 and an obverse surface 24. In the embodiment illustrated, the obverse surface 24 of the front panel 14 has an aesthetically pleasing, fuzzy surface ornamentation in the form of a face of a friendly-looking teddy bear. The rear panel 16 of the pillowcase 12 is a two-ply structure formed of an obverse layer 26 and a reverse layer 28. The two layers 26 and 28 are sewn together, back-to-back so that each of the two layers 26 and 28 of the rear panel 16 exhibits a single, exposed side. The exposed side of the reverse layer 28 forms the reverse surface 30 of the rear pillowcase panel 16 while the exposed side of the obverse layer 26 forms the obverse surface 32 of the rear pillowcase panel 16.

Both the obverse surface 32 and the reverse surface 30 of the rear panel 16 are provided with surface ornamentation thereon. In the embodiment of the invention illustrated, both the obverse surface 32 and the reverse surface 30 of the rear panel 16 are provided with surface decorations in the form of faces of a smiling teddy bear. The obverse surface 32 is formed of the same fuzzy material as the obverse surface 24 of the front panel 14. The outer edges of the front pillowcase panel 14 and the rear pillowcase panel 16 are coterminous and are both circular in shape. Both the front panel 14 and rear panel 16 have the same diameter which may, for example, be about forty-eight centimeters.

The cover 20 is also a two-ply structure which includes a top sheet 34 and a bottom sheet 36. The outer perimeters of the top and bottom sheets 34 and 36 of the cover 20 are mutually congruent with coterminating outer edges that meet and are sewn together throughout their lengths. When the cover 20 is spread out as illustrated in FIG. 6, it may, for example, cover a rectangular area of about ninety centimeters by about one hundred twenty centimeters.

The zipper 18 is a conventional zipper formed of a pair of elongated bands of fabric zipper strips 38 and 40, each bearing mutually interengageable metal or plastic teeth. A metal or plastic slide 42 moves longitudinally along the zipper teeth to engage and disengage the zipper teeth on the zipper strips 38 and 40. The slide 42 has opposing sides with separate pulltabs 44 and 46 extending from each of the two opposing sides of the slide 42. The releaseable fastener zipper strips 38 and 40 are thereby mutually engageable with each other, both when the obverse surfaces 24 and 32 of the front panel 14 and rear panel 16, respectively, face each other, and also when the reverse surfaces 30 and 22 of the rear panel 16 and, front panel 14, respectively, face each other. The pulltab 44 is visible in FIGS. 4, 5, and 6, while the pulltab 46 on the opposite side of the zipper slide 42 is visible in FIGS. 1, 2, 3, and 12. The zipper 18 is a conventional article of manufacture, widely sold at numerous department and a discount store retail outlets.

The zipper strip 38 is sewn in an elongated band throughout an arcuate, semicircular portion of the encompassing perimeter formed by the congruent layers 26 and 28 of the rear panel 16. The zipper band 38 is sewn to the lower arcuate, semicircular portion of the smiling teddy bear face, extending from one side of the face, down below the chin and over to the opposite side of the face, as illustrated. The mating zipper strip 40 is sewn in an elongated band to a corresponding arcuate, semicircular portion of the front panel 14, likewise along the outside of the lower portion of the teddy bear face, and is exposed on the obverse surface 24 of the front panel 14.

The remaining portion of the circular, enclosing perimeter formed by the front panel 14 and rear panel 16 is permanently secured by stitching along the upper, semicircular portions of the fabric layers 26 and 28 forming the reverse panel 16 and the single fabric layer forming the front panel 14. The stitching extends through the upper, semicircular portions of the fabric layers 26, 28, and 14 and through the corresponding semicircular upper portion of the inner margin of the cover 20 adjacent the inner edge 50 of the fabric layer 34 bounding the circular opening 48 through the fabric layer 34. In addition, the remaining semicircular portion of the front pillowcase panel 14 is sewn to the interior, adjacent margin of the cover layer 34, beneath the chin of the teddy bear face on the obverse surface 24, in such a manner as to leave the zipper band 40 exposed on the top surface of the cover fabric layer 34 which is visible in FIG. 6.

The front panel 14 is comprised of a circular, flexible fabric structure that is sewn throughout its perimeter to the central region of the cover 20. This central, circular region is delineated by the central, circular demarcation boundary 50 that forms the interior circular edge of the opening 48 in the top layer 34 of the cover 20. The rear panel 16 of the pillowcase 12 is a circular, flexible fabric structure having the same diameter as the front panel 14. The rear panel 16 is sewn to both the front panel 14 and to the perimeter of the central region 48 of the cover 20 over an arcuate, semicircular portion of the demarcation boundary 50. The rear panel 16 is sewn to the cover 20 and to the front panel 16 throughout the arcuate, semicircular portion of the enclosing circular perimeter defined by the congruent front and rear panels 14 and 16, respectively. The upper, arcuate, semicircular portion of this perimeter extends over the top of the teddy bear faces illustrated on the front and rear panels 14 and 16 where the several layers are secured by stitching. The releaseable fastener zipper strips 38 and 40 extend along the remaining portion of the enclosing perimeter.

Once the front and rear pillowcase panels 14 and 16 have been sewn together to each other, and to the fabric layer 34 of the cover 20, a sheet of soft foam batting or insulation (not shown) may be inserted between the fabric layers 34 and 36. The fabric layers 34 and 36 are mutually congruent and peripheral outer edges of the fabric layers 34 and 36 of the cover 20 are sewn together throughout. The cover 20 thereby forms a child's comforter. With this construction, the area of the cover 20 occupied by the structure of the upper layer 34 may be considered to comprise peripheral portions of the cover 20 that extended laterally from and surround the central region thereof, which is located at the central opening 48 in the fabric layer 34. The central opening 48 in the layer 34 is filled by the structure of the reverse surface 22 of the front panel 14. The circular fabric layer formed by the reverse surface 22 occupies the circular, central region of the cover 20.

Figure 5:
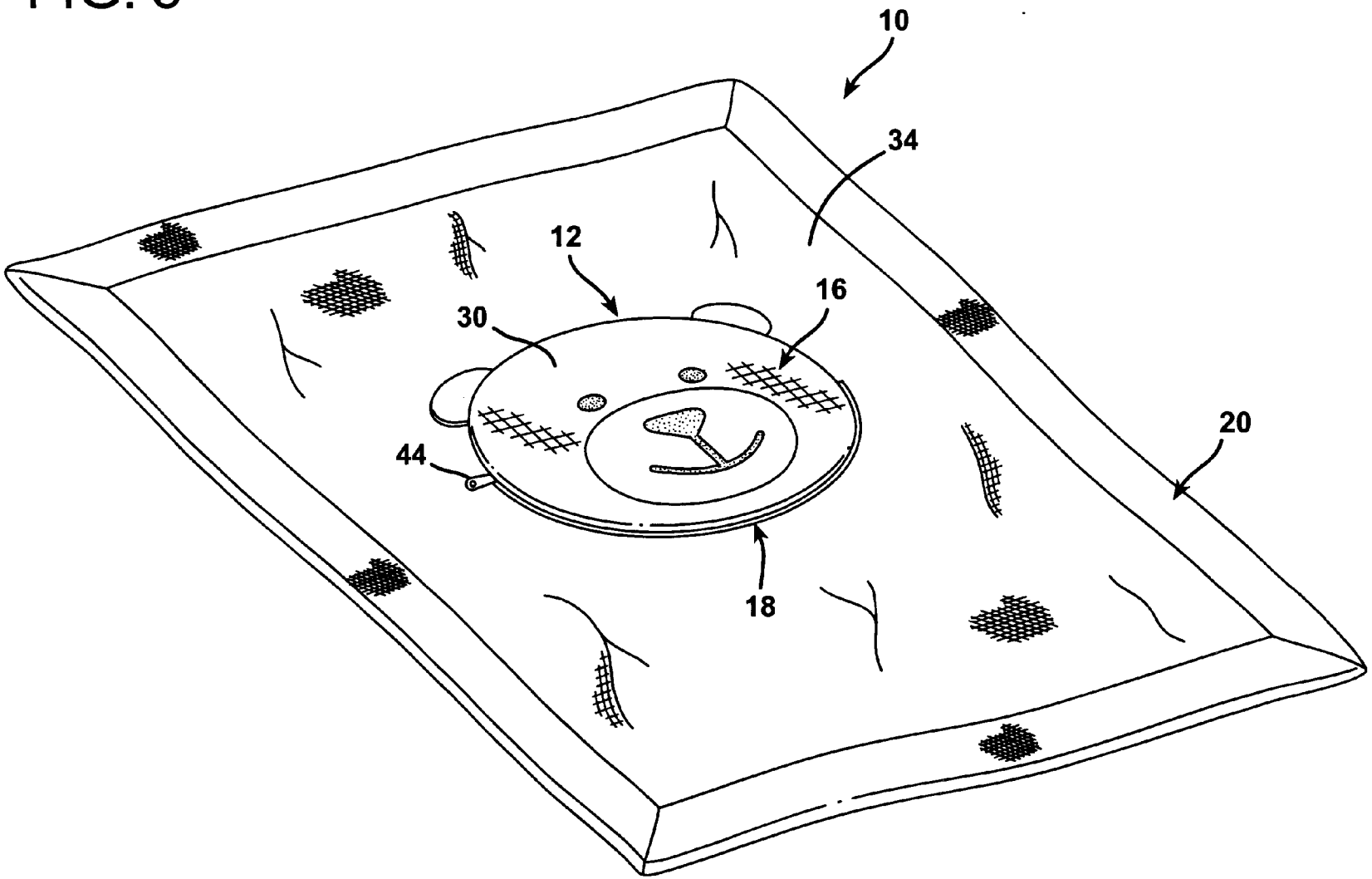
FIG. 5 illustrates the article of FIG. 1 completely converted to a cover surmounted by the pillowcase.

FIG. 5 illustrates the pillowcase with integral structure 10 with the cover 20 extended from the pillowcase 12 and spread laterally therefrom in all directions. In this condition the cover 20 is unfolded so that the peripheral portions of the cover 20 defined by the fabric layer 34 are withdrawable from the pillowcase 12 to surround the front panel 14 when the releaseable fasteners formed by the teeth on the zipper strips 38 and 40 have been disengaged from each other by operation of the zipper slide 42. It is apparent that in the condition of FIG. 5 the structure 10 can perform the function of a comforter or blanket having an aesthetically attractive surface ornamentation at its center. In this condition the rear panel 16 lies directly atop the front panel 14 so that the pillowcase 12 surmounts the cover 20. The reverse surface 30 of the rear panel 16 forms an attractive ornamentation on the exposed top surface of the underlying cover 20.

If desired, small articles, for example socks or slippers, can be placed in between the obverse surface 32 of the rear panel 16 and the obverse surface 24 of the front panel 14 and the zipper slide 42 operated to completely enclose the outer edges of the front and rear panels 14 and 16. The space between the obverse surfaces 24 and 32 of the panels 14 and 16, respectively, can thereupon be used for temporary storage of articles.

Figure 7:
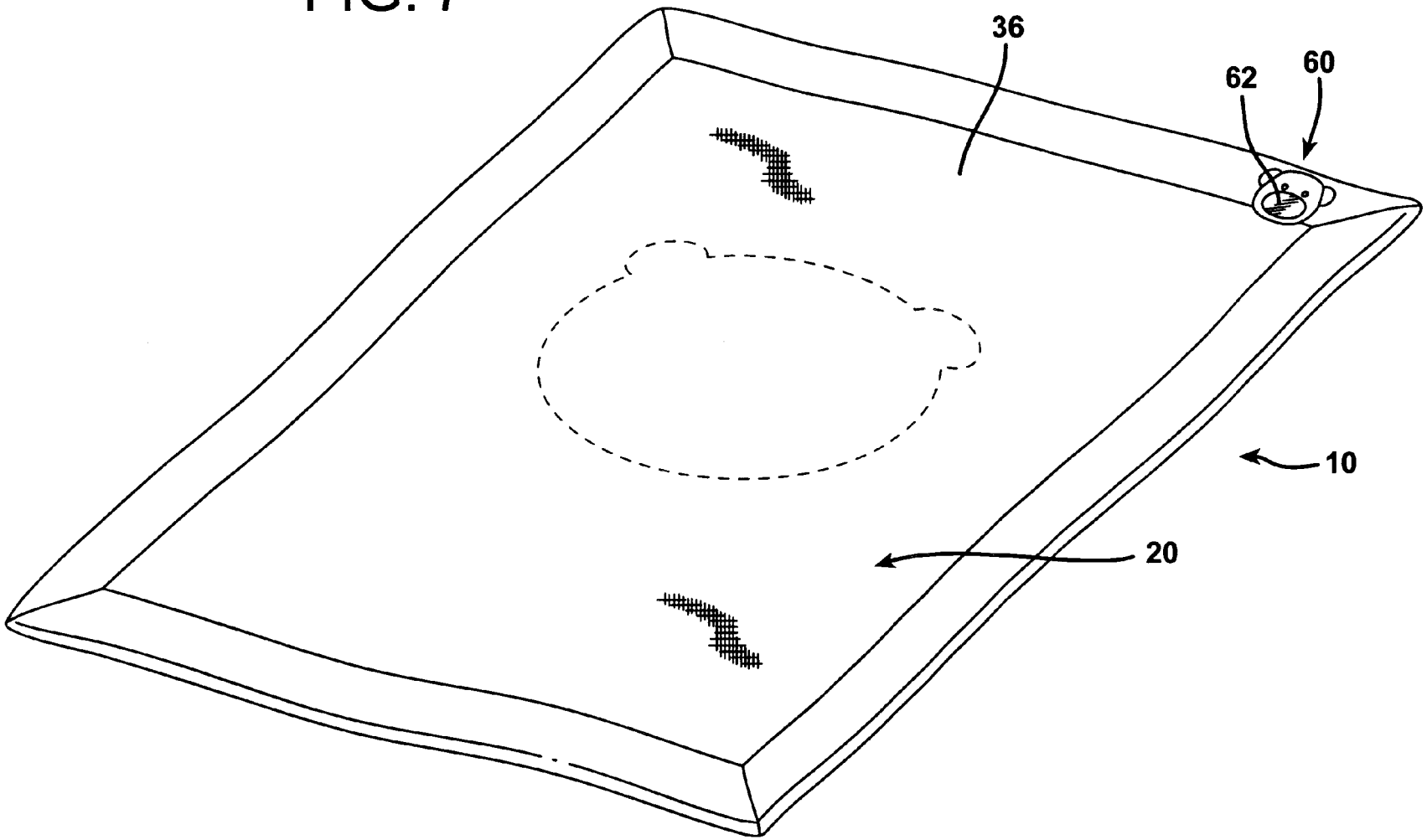
FIG. 7 illustrates the bottom side of the cover shown in FIG. 5.
Figure 8:
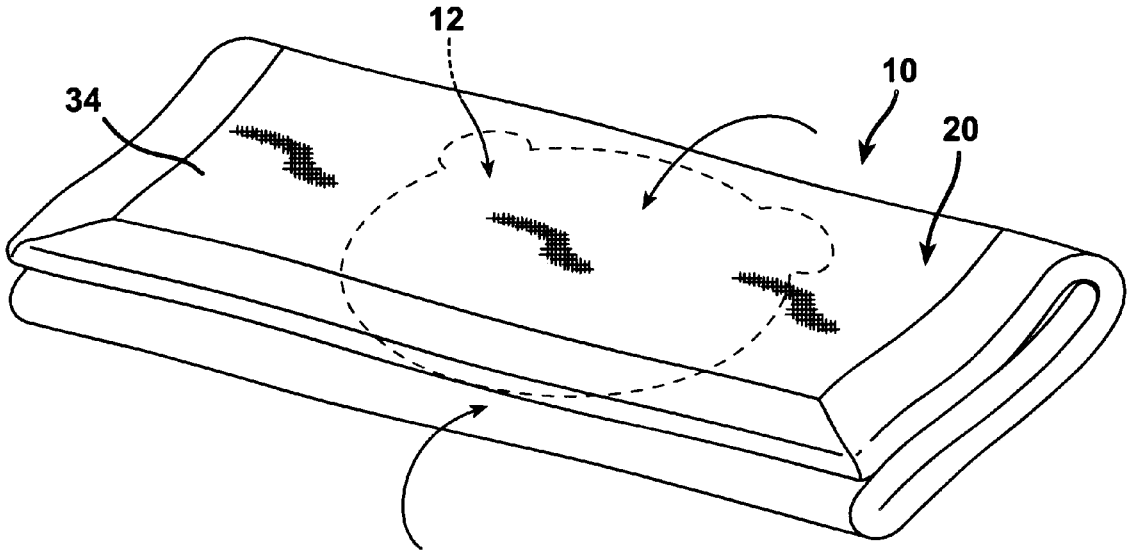
FIG. 8 illustrates the cover being folded from the fully extended position illustrated in FIG. 7.
Figure 9:
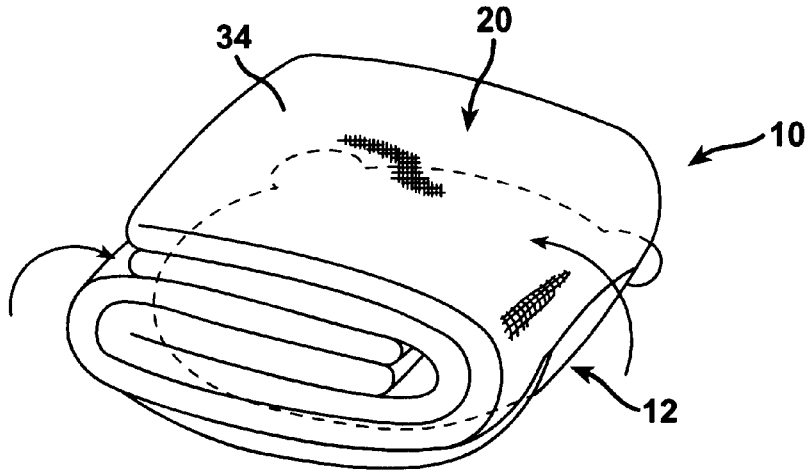
FIG. 9 illustrates a further step in the folding of the cover from the condition of FIG. 8.
Figure 10:
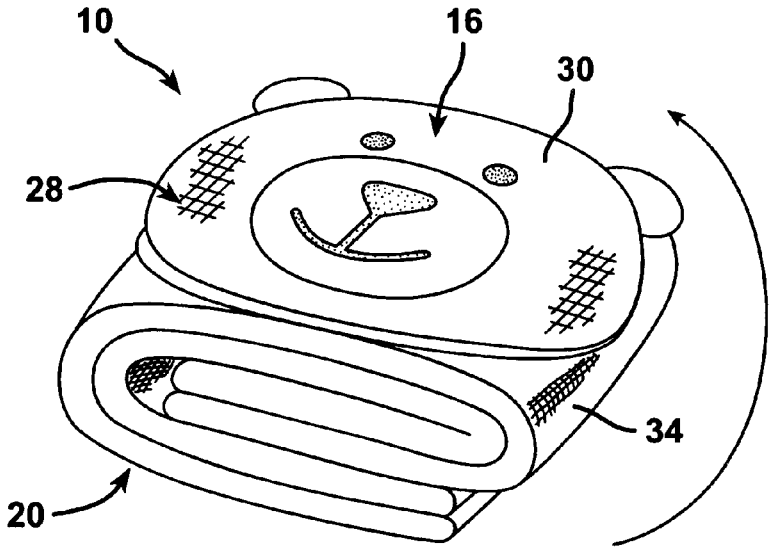
FIG. 10 illustrates the article in an inverted condition from that shown in FIG. 9.

When the user is finished employing the device 10 as a cover, it may be quickly and readily collapsed and stored in its integral container. In preparation for storage, the cover 20 is turned over from the disposition illustrated in FIG. 5 in which the upper surface of the top layer 34 of the cover 20 is exposed to the disposition of FIG. 7 in which the underside of the bottom layer 36 is exposed. The peripheral portions of the cover 20 are then folded back in a lengthwise direction, as illustrated in FIG. 8 into folds approximately equal to the height of the front and rear panels 14 and 16. The folded ends of the cover 20 are then folded in toward the center and over each other, as illustrated in FIG. 9 so that the stacked layers of the cover 20 cover an area approximately equal to the area of the pillowcase 12. The folded toss pillow with integral cover 10 may then be turned over so that the pillowcase 12 resides atop the cover 20, which is folded therebeneath, as illustrated in FIG. 10. In this condition the reverse surface 30 of the rear panel 16 is exposed and faces upwardly and the rear panel 16 covers and conceals the front panel 14 of the pillowcase 12.

Figure 11:
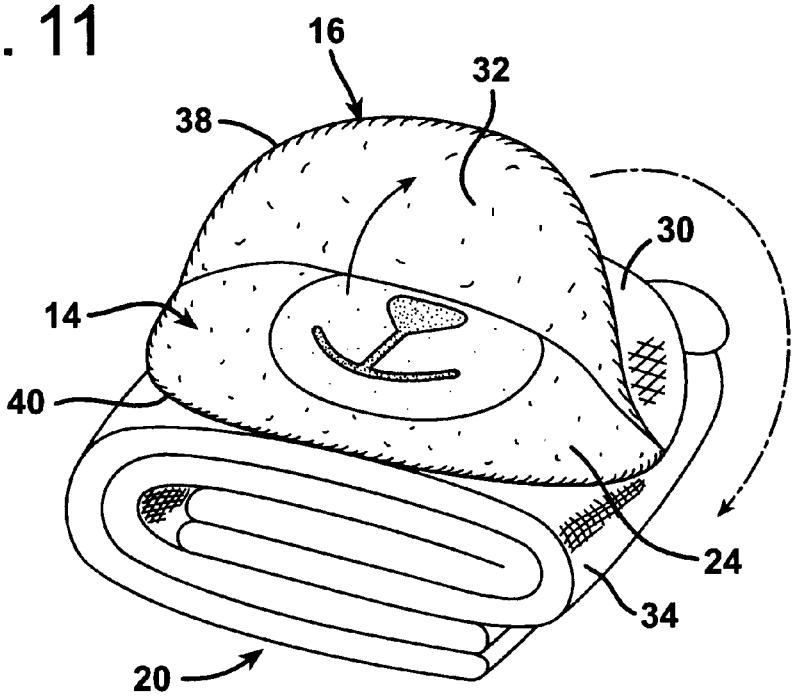
FIG. 11 illustrates the rear pillowcase panel being returned to an orientation for enveloping the cover.
Figure 12:
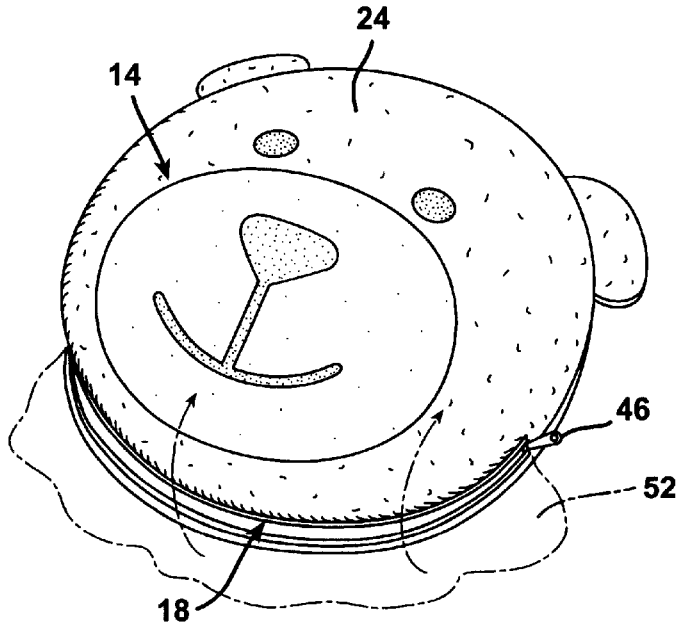
FIG. 12 illustrates the final step of stuffing the entire cover back in between the pillowcase panels in order to return the article to the condition illustrated in FIG. 1.

The lower edge of the rear panel 16, at approximately the area of the teddy bear's chin, is then pulled upwardly and rearwardly and away from the front panel 14 while holding the folded layers of the cover 20 compressed together. The rear panel 16 is pulled back over the top of the front panel 14, as illustrated in FIG. 11, and beneath the folded layers of the cover 20, as illustrated in FIG. 12, thereby bringing the reverse surfaces 30 and 22 of the pillowcase panels 16 and 14, respectively, into a face-to-face orientation with the folded cover 20 disposed therebetween. Any peripheral margins 52 of the cover 20 that may be protruding from between the zipper strips 38 and 40 are then stuffed back in between the zipper strips 38 and 40. The zipper slide 42 is then operated by means of the pulltab 46 pulling it in a clockwise direction, as viewed in FIG. 12, from right to left to releaseably secure the teeth of the zipper strips 38 and 40 together and to totally encapsulate the cover 20 between the reverse surface 22 of the front panel 14 and the reverse surface 30 of the rear panel 16. In this condition the device 10 appears as illustrated in FIG. 1.

The cover 20 thereupon serves as stuffing within the pillowcase 12 when the releaseable fasteners formed by the teeth of the zipper strips 38 and 40 are engaged. The structure 10 will thereafter function as a toss pillow, as illustrated in FIG. 1, without any possibility that the cover 20 will become unfolded or escape from within its confines between the pillowcase panels 14 and 16.

Figure 2:
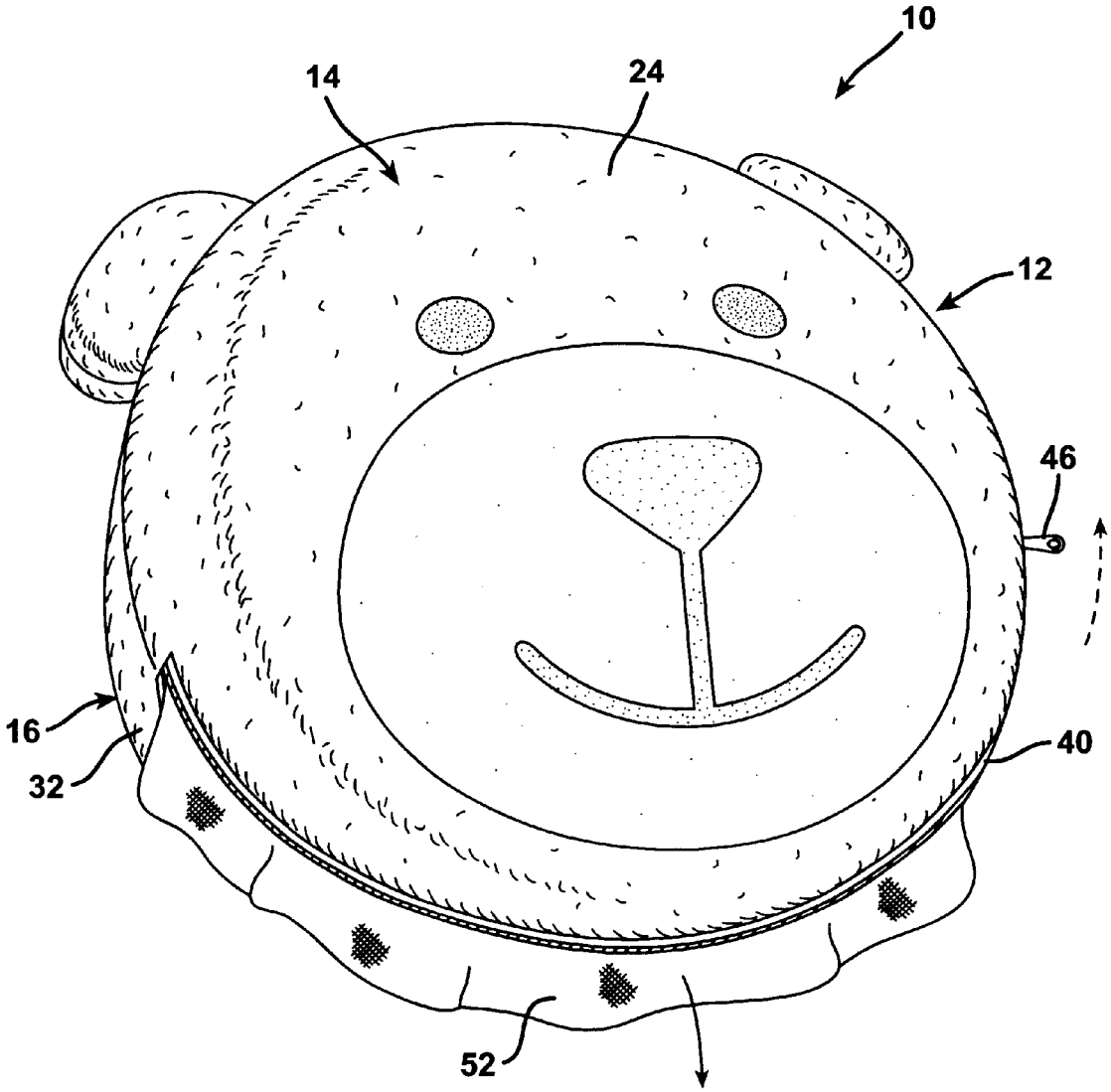
FIG. 2 illustrates the pillow of FIG. 1 with its releaseable fasteners disengaged and with the encapsulated cover being withdrawn therefrom.

The opposite procedure is used to extract the peripheral portions of the cover 20 from within the pillowcase 12. That is, and with reference to drawing FIGS. 1 and 2, the zipper slide 42 is pulled by means of the pulltab 46 in a counter clockwise direction to separate the interengaged teeth of the zipper strips 38 and 40. To do this the zipper slide 42 is pulled from left to right, as illustrated in FIGS. 1 and 2. Once the teeth of the zipper strips 38 and 40 are separated, the peripheral margins 52 of the peripheral portions of the cover 20 can be drawn out from between the zipper strips 38 and 40, as shown in FIG. 2, and the entire cover 20 can be pulled out of the pillowcase 12, as illustrated in FIG. 3.

Figure 3:
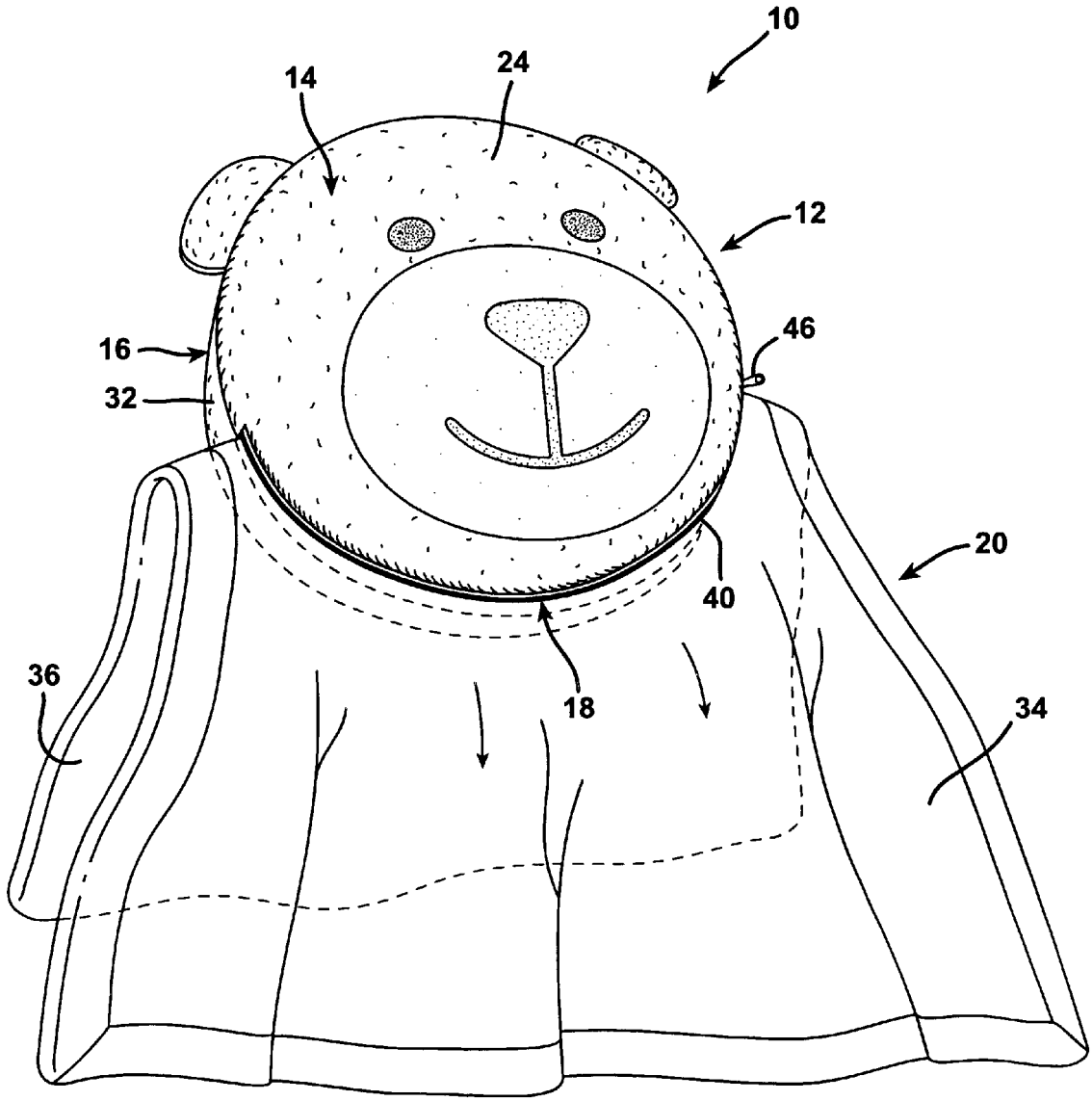
FIG. 3 illustrates the pillow of FIG. 2 with the cover more completely withdrawn from between the pillowcase panels.
Figure 4:
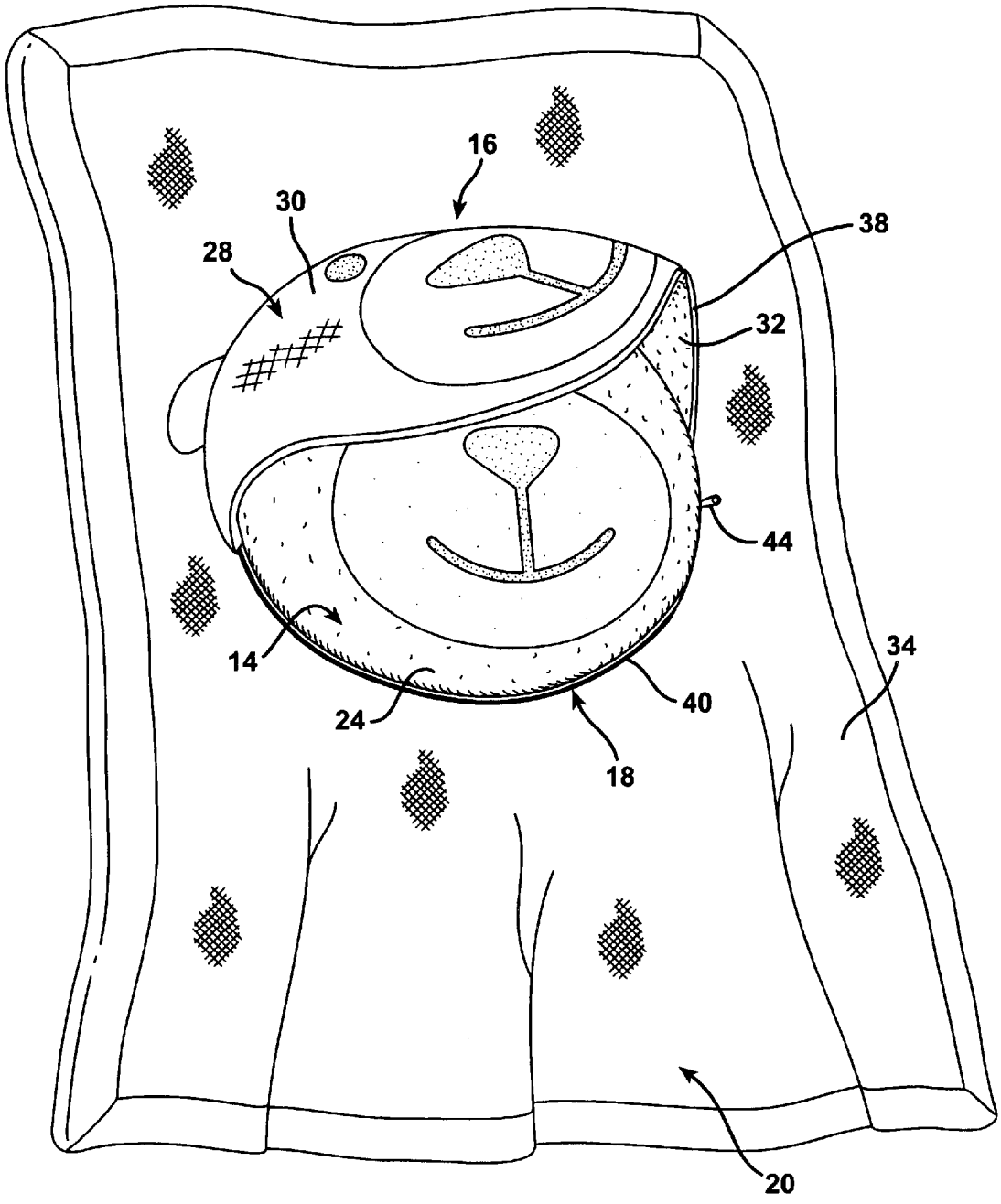
FIG. 4 illustrates the cover in a completely withdrawn condition and with the rear pillowcase panel being reversed in orientation relative to the front pillowcase panel.

Once the cover 20 has been withdrawn from within the enclosure defined between the reverse surface 22 of the front pillowcase panel 14 and the reverse surface 30 of the rear pillowcase panel 16, as shown in FIG. 3, the orientation of the rear pillowcase panel 16 may then be reversed as shown in FIG. 4. That is, the lower edge of the rear panel 16 opposite the permanently secured upper edge is pulled upwardly away from the cover 20 while pressing downwardly on the upper portion of the obverse face 24 of the front panel 14. This reversal of the orientation of the rear panel 16 from a disposition in which the reverse faces 22 and 30 of the front panel 14 and rear panel 16, respectively, are in a face-to-face relationship to, a disposition in which the obverse faces 24 and 32 reside in a face-to-face relationship brings the reverse surface 30 of the rear panel 16 into an exposed condition atop the cover 20. As previously indicated, this reversal of orientation of the rear panel 16 brings the pulltab 44 into an accessible position where it can be pulled in a clockwise direction, as viewed in FIGS. 4 and 5, to reengage the zipper strips 38 and 40 together.

Undoubtedly, numerous variations and modifications of the invention will become readily apparent to those familiar with bedding and other sheet-like fabric materials that require storage. For example, a small name tag holder 60 may be provided on the marginal border of the underside of the bottom layer 36 of the cover 20, as illustrated in FIG. 7. The name tag holder 60 may be open along one edge and may include a transparent window 62. A name tag card bearing the name of the owner may be inserted through the open edge of the name tag holder 60 so that the name of the owner is visible through the window 62 from the undersurface of the cover 20.

Figure 13:
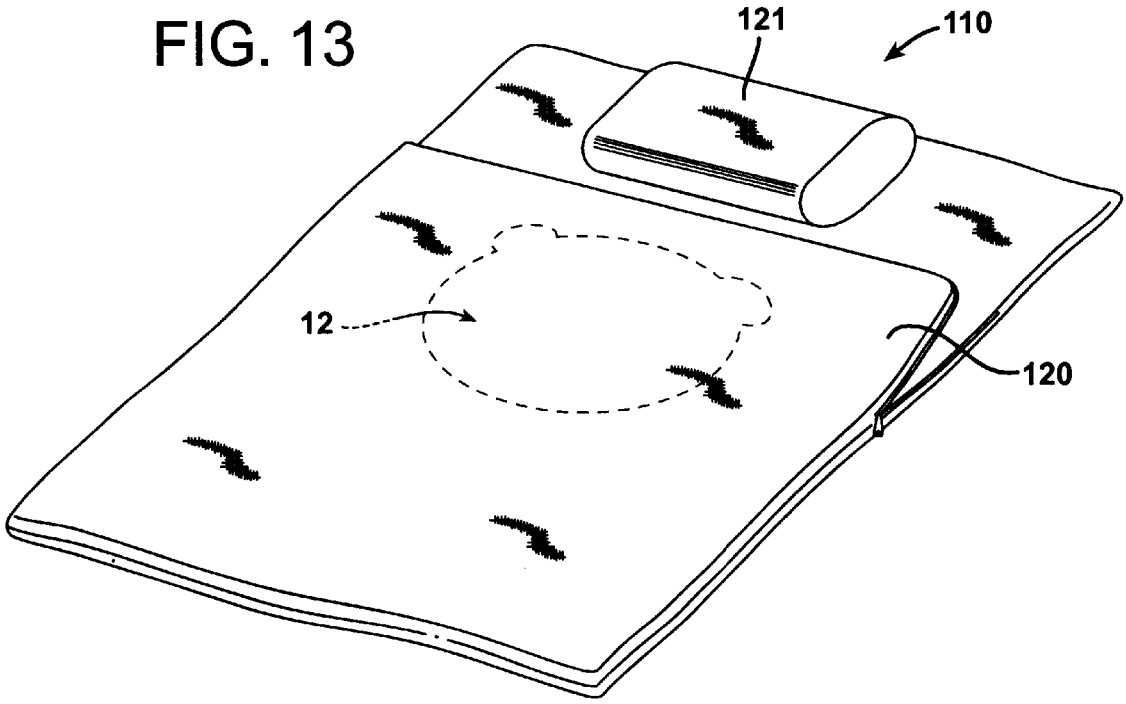
FIG. 13 illustrates an alternative embodiment in the form of a sleeping bag constructed according to the invention.

Also, the invention is not limited to blankets and comforters, or the like. FIG. 13 illustrates a sleeping bag 110 formed with a sheet-like sleeping bag mattress 120 having a soft, pillow 121 secured thereto which may be encapsulated within a pillowcase 12 and otherwise utilized in the same manner illustrated in FIGS. 1 through 12. Beach towels and other articles of manufacture may be constructed in the same way.

Also, fasteners other than zippers may be employed to form the releaseable closure mechanism of the invention. For example, fabric hook and loop fabric fasteners, such as those sold under the registered trademark Velcro® may be employed. Likewise, snap fasteners and buttons may be utilized in place of the zippers illustrated in the embodiments shown. Accordingly, the scope of the invention should not be construed as limited to the specifics embodiment depicted and described, but rather is defined in the claims appended hereto.

What is claimed is:

1. A combination comprising:

a pillowcase formed with front and rear panels each having an obverse and a reverse surface and said panels both have outer edges that meet to define an encompassing perimeter, and mutually engageable releaseable fasteners releaseably engage said panels together along at least a portion of said encompassing perimeter, and an expansive cover including a top sheet and a bottom sheet both having outer edges that meet and are sewn together throughout their lengths, and said top sheet and said bottom sheet respectively define top and bottom cover surfaces and said top sheet has a central opening therein delineating a central region in said top cover surface, and said cover has peripheral portions that project outwardly from said central opening beyond said central region, and said outer edge of said front panel of said pillowcase is secured throughout to said top surface of said cover about the entire perimeter of said central opening, thereby filling said central region, and whereby said expansive cover is foldable for insertion in between said reverse surfaces of said pillowcase panels for complete encapsulation therebetween so that said cover is totally enveloped between said front and rear panels of said pillowcase, and said cover is also unfoldable so that said pillowcase surmounts said cover with said peripheral portions of said cover spread beyond and surrounding said pillowcase.

2. A combination according to claim 1 further characterized in that said panels are permanently secured together about a permanently attached portion of said encompassing perimeter.

3. A combination according to claim 2 further characterized in that said panels are both permanently secured to each other and to said cover along said permanently attached portion of said encompassing perimeter.

4. A combination according to claim 3 further characterized in that said permanently attached portion extends along one-half of the total length of said encompassing perimeter.

5. A combination according to claim 3 wherein said rear panel is reversible and is positionable relative to said front panel so that said reverse surfaces of said panels face other, and alternatively so that said obverse surfaces of said panels face each other, and said releaseable fasteners are engageable with each other both when said reverse surfaces of said panels face each other and when said obverse surfaces of said panels face each other.

6. A combination according to claim 5 wherein said obverse surface of said front panel is provided with surface ornamentation and both said obverse and reverse surfaces of said rear panel are provided with surface ornamentation thereon.

7. A combination according to claim 5 wherein said releaseable fasteners are comprised of interengageable elements of a zipper having a slide with opposing sides, and separate pulltabs are provided on each of said opposing sides of said slide.

8. A combination according to claim 5 wherein said encompassing perimeter is circular in shape.

9. A combination according to claim 1 wherein said cover is a comforter.

10. A self-storing article of bedding comprising:

an expansive cover form of top and bottom sheet having outer edges and said top sheet is formed with a central opening therein delineated by a demarcation boundary within which a central region is defined surrounded on all sides by peripheral portions, and said top and bottom sheets meet at peripheral edges which are sewn together throughout and said top and bottom sheet respectively define top and bottom cover surfaces, a pillowcase formed of opposing front and rear panels each having an obverse surface and a reverse surface, and said front and rear panels have edges that meet to form an enclosing perimeter, at least a portion of which is bounded by mutually engageable, releaseable fasteners on both of said front and rear panels, and said front panel is located at said central region of said cover, and is sewn onto said top sheet of said cover throughout said demarcation boundary, thereby completely filling said central opening in said top sheet, and whereby said peripheral portions of said cover are foldable toward said central region thereof and said releaseable fasteners are engageable so that said obverse surfaces of both said front and rear panels of said pillowcase are exposed with said cover entirely encapsulated between said reverse surfaces of said front and rear panels so that said cover thereupon serves as stuffing enveloped entirely within said pillowcase, and said cover is alternatively withdrawable from said pillowcase to completely surround and extend beyond said enclosing perimeter of said pillowcase panels.

11. An article according to claim 10 wherein said enclosing perimeter is circular in shape and said front and rear panels are permanently secured to each other along an arcuate portion of said enclosing perimeter and said releaseable fasteners extend along the remaining portion of said enclosing perimeter.

12. An article according to claim 11 wherein said rear panel is reversible and is positionable relative to said front panel so that said reverse surfaces thereof are in mutually facing orientation and is alternatively positionable relative to said front panel so that said obverse surfaces thereof are in mutually facing orientation.

13. An article according to claim 1 wherein said cover is formed of top and bottom sheets and said rear panel is comprised of a circular, flexible, fabric structure having the same diameter as said front panel and said rear panel is sewn to both said front panel and to said top sheet at said central region of said cover throughout an arcuate portion of said enclosing perimeter and said releaseable fasteners are located along the remaining portions of said enclosing perimeter.

14. An article according to claim 10 wherein said releaseable fasteners are formed by elements of a zipper having a slide with opposing sides and a separate pulltab on each of said opposing sides of said zipper slide.

15. A pillow with an integral cover comprising:

a pillowcase formed of front and rear panels of flexible, fabric material, wherein each of said front and rear panels has an obverse and a reverse surface, and said front and rear panels have outer edges that meet to form an enclosing perimeter, mutually engageable fasteners extending along at least a portion of said enclosing perimeter, an expansive, flexible, fabric cover formed of a top sheet lying upon a bottom sheet and wherein both said top and bottom sheets have outer edges that meet and are sewn together throughout a total area greater than the area of said enclosing perimeter of said pillowcase and a central opening is formed in said top sheet to delineate a central region of said cover, and said outer edge of said front panel is sewn throughout to said top sheet of said cover, whereby said front panel completely fills said central opening in said top sheet of said cover, and said cover has peripheral portions that are foldable back toward said central region to reside within the area of said central region, whereby said expansive cover is foldable for complete encapsulation between said reverse surfaces of said front and rear panels to serve as stuffing within said pillowcase when said releaseable fasteners are engaged, and whereby said peripheral portions of said expansive covering are withdrawable from between said reverse surfaces of said front and rear panels and said cover is unfoldable when said releaseable fasteners are disengaged so that said peripheral portions thereof are extended beyond said pillowcase to surround said pillowcase.

16. A pillow with an interval cover according to claim 15 wherein said front and rear panels are permanently secured to each other along a portion of said enclosing perimeter and said releaseable fasteners extend along the remainder of said enclosing perimeter and said cover is comprised of separate top and bottom plies of material, and said front panel is permanently secured throughout said enclosing perimeter to said top ply of said cover at said demarcation boundary, and said outer edges of said top and bottom plies of said cover are secured to each other throughout.

17. A pillow with an integral cover according to claim 16 wherein said rear panel is reversible and is foldable so that said obverse surface thereof faces said obverse surface of said front panel and said releaseable fasteners are mutually engageable with each other both when said obverse surfaces of said panels face each other and also when said reverse surfaces of said panels face each other.

18. A pillow with an interval cover according to claim 16 wherein said releaseable fasteners are comprised of zipper strips with mutually interengageable teeth and a zipper slide with opposing sides and pulltabs on both of said opposing sides.

19. A pillow with an integral cover according to claim 17 wherein both of said obverse surfaces of said panels are provided with surface ornamentation and said reverse surface of said rear panel is also provided with surface ornamentation.

* * * * *